US007549416B2

(12) United States Patent
Lin

(10) Patent No.: US 7,549,416 B2
(45) Date of Patent: Jun. 23, 2009

(54) LAUNCH VEHICLE

(76) Inventor: Jeng-Chian Lin, 25, Lane 78, Dongying 2nd St., East District, Taichung City (TW)

( * ) Notice: Subject to any disclaimer, the term of this patent is extended or adjusted under 35 U.S.C. 154(b) by 524 days.

(21) Appl. No.: 11/454,769

(22) Filed: Jun. 16, 2006

(65) Prior Publication Data

US 2007/0289585 A1 Dec. 20, 2007

(51) Int. Cl.
*F41B 11/08* (2006.01)
*F41B 11/00* (2006.01)
*A63H 27/26* (2006.01)

(52) U.S. Cl. ..... 124/65; 124/57; 124/66; 124/69; 124/71; 124/73; 446/56; 446/63; 446/211; 446/212; 446/429

(58) Field of Classification Search ..... 124/57, 124/65–77; 446/211, 212, 429, 56, 63
See application file for complete search history.

(56) References Cited

U.S. PATENT DOCUMENTS 5,373,833 A * 12/1994 D'Andrade ..... 124/69
5,415,153 A * 5/1995 Johnson et al. ..... 124/63
5,819,717 A * 10/1998 Johnson et al. ..... 124/65
6,321,737 B1 * 11/2001 Johnson et al. ..... 124/73
7,216,642 B2 * 5/2007 Poesch et al. ..... 124/60

* cited by examiner

*Primary Examiner*—Troy Chambers
*Assistant Examiner*—Daniel J Troy
(74) *Attorney, Agent, or Firm*—Banger Shia

(57) ABSTRACT

A launch vehicle includes an air pump, an injection valve, a connecting member, a trigger, and a projectile. Thus, the launch vehicle is operated on the ground and is also operated in a hand-held manner, thereby enhancing the amusement effect of the launch vehicle. In addition, the user only needs to hold the air pump and the trigger so as to launch the projectile easily and conveniently in an energy-saving manner, thereby facilitating the user operating the launch vehicle. Further, the launch vehicle has a simplified construction to perform the hand-held launching function, thereby decreasing the costs of fabrication. Further, the launch vehicle is further provided with a safety device to prevent the trigger from being triggered unintentionally to protect the user's safety.

20 Claims, 8 Drawing Sheets

LAUNCH VEHICLE

BACKGROUND OF THE INVENTION

1. Field of the Invention

The present invention relates to a launch vehicle and, more particularly, to a hand-held launch vehicle.

2. Description of the Related Art

A conventional launch vehicle comprises a support frame placed on the ground, an injection valve mounted on the support frame and including a positioning seat having a first end provided with an air nozzle connected to an air pipe of an air pump, a plurality of locking members each mounted on the positioning seat and a press ring movably mounted on the positioning seat and rested on the locking members to press the locking members into the inside the positioning seat, and a projectile detachably mounted on the second end of the positioning seat of the injection valve and provided with a plug inserted into the positioning seat and detachably locked by the locking members of the injection valve. The projectile contains water and gas therein.

In operation, the ambient air is filled into the projectile by the air pump so as to boost the projectile. Thus, when the press ring of the injection valve is pulled by the user, the press ring of the injection valve is moved to detach from the locking members to release and detach the locking members from the plug of the projectile, so that the projectile is released from the injection valve and can be injected outwardly by the pressurized air contained in the projectile. In such a manner, the launch vehicle is operated on the ground.

However, the launch vehicle is operated on the ground and cannot be operated in a hand-held manner, thereby decreasing the amusement effect of the launch vehicle. In addition, the support frame is placed on the ground, so that the launch vehicle is limited to the condition of the ground and cannot be operated on an uneven or muddy ground. Further, the launch vehicle has a larger volume due to the support frame, so that the launch vehicle cannot be carried easily and conveniently, thereby causing inconvenience to the user when carrying and storing the launch vehicle.

BRIEF SUMMARY OF THE INVENTION

In accordance with the present invention, there is provided a launch vehicle, comprising an air pump including a cylinder having an upper end formed with an air outlet connected to an inside of the cylinder and a lower end provided with a piston rod movable in the inside of the cylinder, an injection valve mounted on the air pump and including a positioning seat having a first end provided with an air nozzle inserted into the air outlet of the cylinder and a second end formed with a positioning recess, a plurality of flexible locking members each mounted on the positioning seat and each retractably extended into the positioning recess of the positioning seat, and a press ring movably mounted on the positioning seat and movable between a first position where the press ring is rested on the locking members to press the locking members into the positioning recess of the positioning seat and a second position where the press ring is detached from the locking members to release the locking members from the positioning recess of the positioning seat, a connecting member mounted between the air outlet of the cylinder of the air pump and the positioning seat of the injection valve to attach the injection valve to the air pump, a trigger secured to the press ring of the injection valve to move the press ring, and a projectile detachably mounted on the injection valve and including a mounting seat detachably mounted on the positioning seat of the injection valve, and a projectile body mounted on the mounting seat. The mounting seat of the projectile is provided with a plug inserted into the positioning recess of the positioning seat and detachably locked by the locking members of the injection valve.

The primary objective of the present invention is to provide a launch vehicle, wherein the launch vehicle is operated on the ground and is also operated in a hand-held manner, thereby enhancing the amusement effect of the launch vehicle.

Another objective of the present invention is to provide a launch vehicle, wherein the user only needs to hold the air pump and the trigger so as to launch the projectile easily and conveniently in an energy-saving manner, thereby facilitating the user operating the launch vehicle.

A further objective of the present invention is to provide a launch vehicle, wherein the launch vehicle has a simplified construction to perform the hand-held launching function, thereby decreasing the costs of fabrication.

A further objective of the present invention is to provide a launch vehicle, wherein the launch vehicle has a smaller volume and is carried easily and conveniently, thereby facilitating the user carrying and storing the launch vehicle.

A further objective of the present invention is to provide a launch vehicle, wherein the launch vehicle is further provided with a safety device to prevent the trigger from being triggered unintentionally so as to protect the user's safety.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
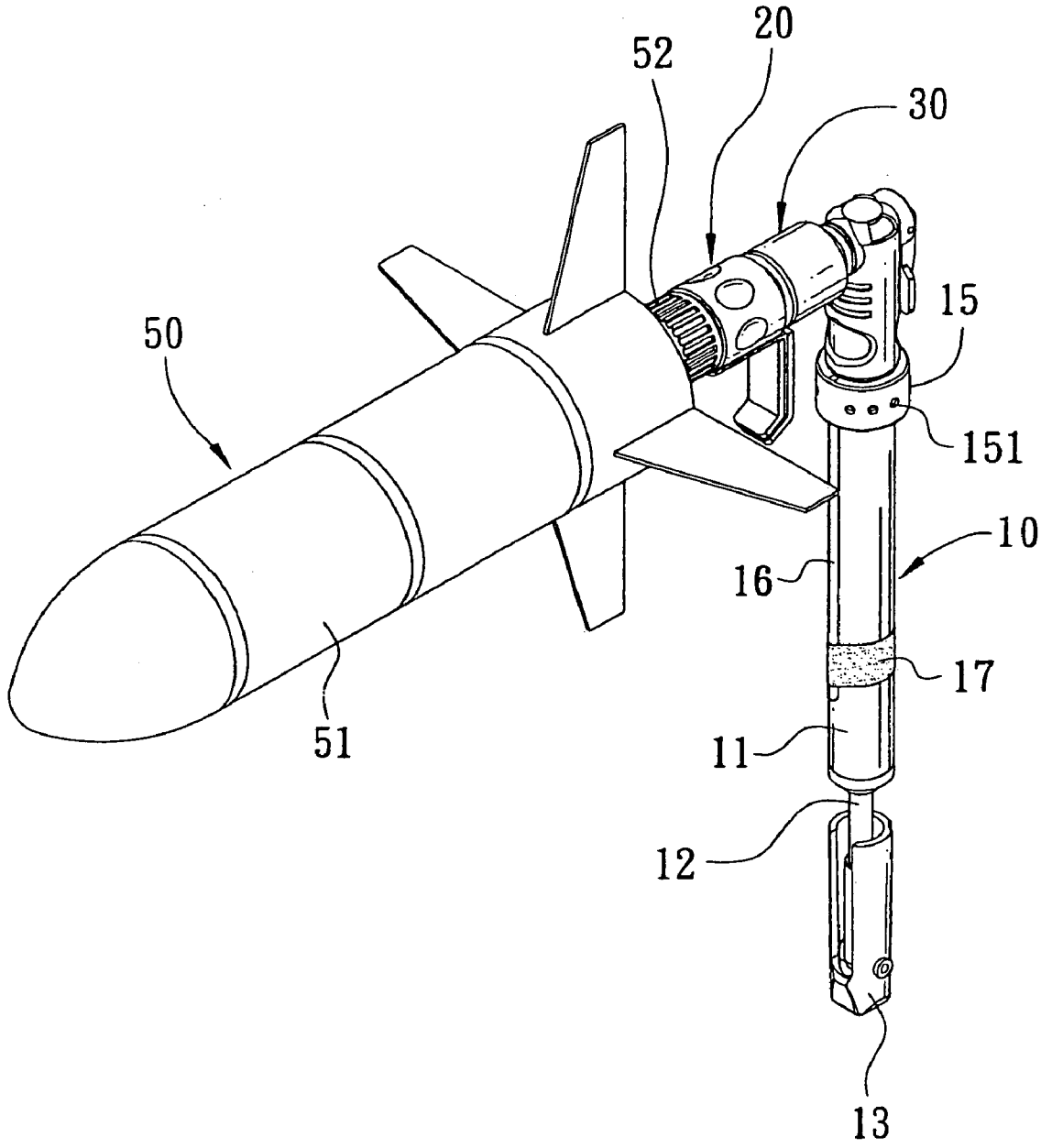
FIG. 1 is a perspective view of a launch vehicle in accordance with the preferred embodiment of the present invention.
Figure 2:
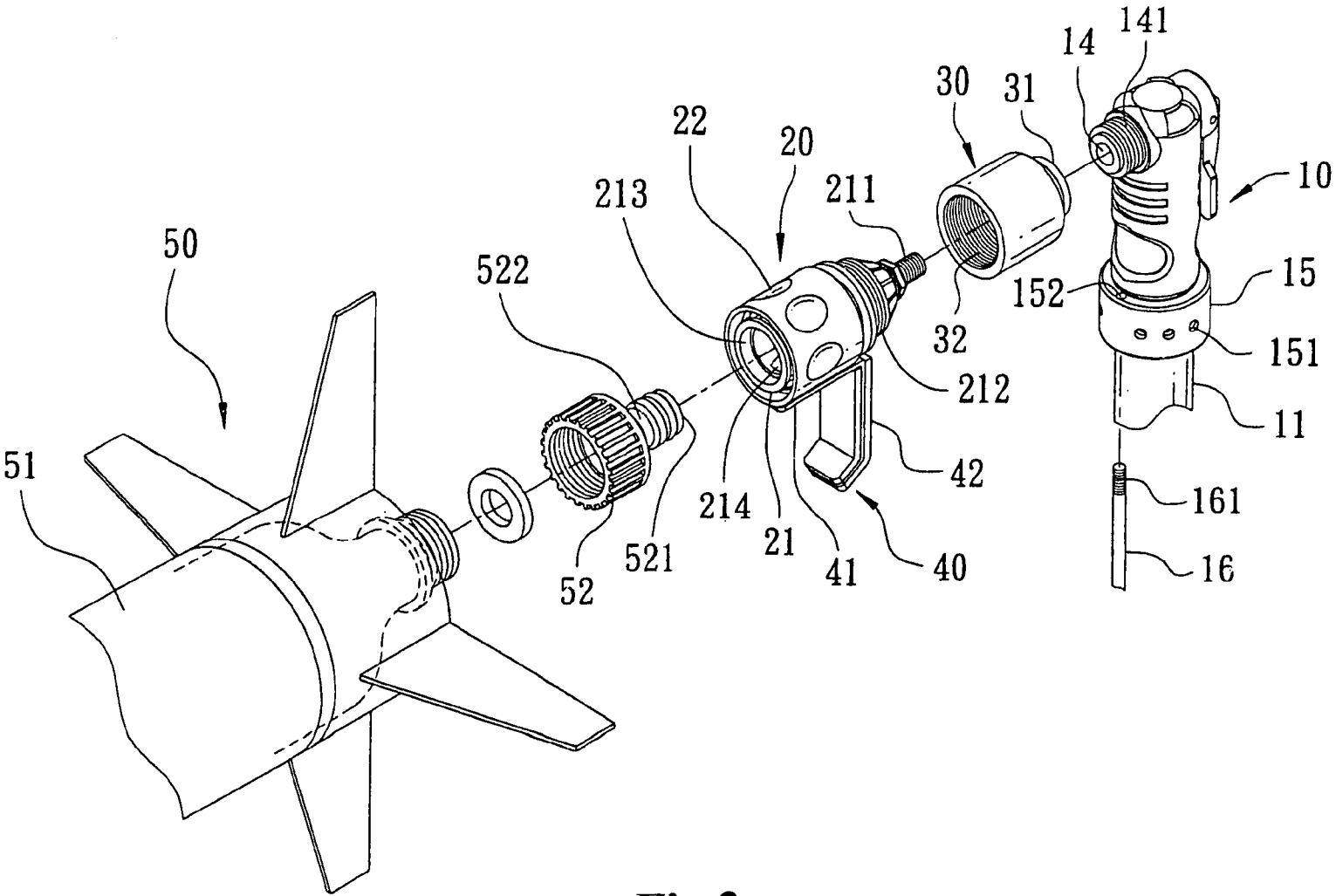
FIG. 2 is a partially exploded perspective view of the launch vehicle as shown in FIG. 1.
Figure 3:
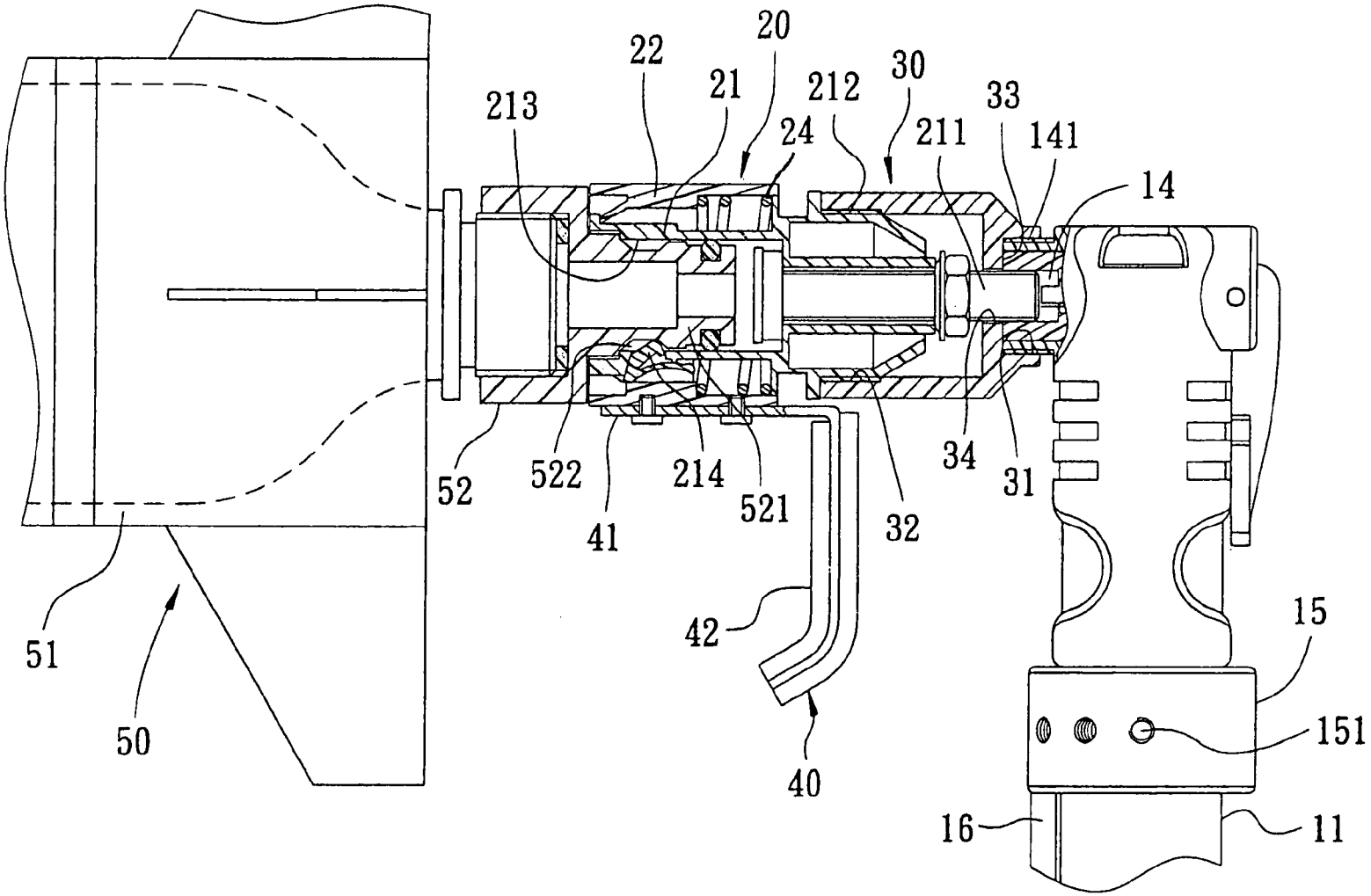
FIG. 3 is a partially plan cross-sectional view of the launch vehicle as shown in FIG. 1.

Referring to the drawings and initially to FIGS. 1-3, a launch vehicle in accordance with the preferred embodiment of the present invention comprises an air pump 10, an injection valve 20, a connecting member 30, a trigger 40, and a projectile 50.

The air pump 10 includes a cylinder 11, a sleeve 15 mounted on an outer wall of the cylinder 11, a support rod 16 mounted on the cylinder 11 and having a first end detachably secured to the sleeve 15, and an elastic clamping ring 17 mounted on the cylinder 11 and rested on a second end of the support rod 16. The cylinder 11 has an upper end formed with an air outlet 14 connected to an inside of the cylinder 11. The air outlet 14 of the cylinder 11 has a peripheral wall provided with an outer thread 141. The cylinder 11 has a lower end provided with a piston rod 12 movable in the inside of the cylinder 11. The piston rod 12 has a lower end provided with a foldable handle 13. The sleeve 15 has a plurality of radially extending threaded positioning holes 151 arranged in an annular manner and an axially extending threaded fixing hole 152 perpendicular to each of the positioning holes 151. The first end of the support rod 16 has a threaded portion 161 selectively screwed into the fixing hole 152 of the sleeve 15 or any one of the positioning holes 151 of the sleeve 15.

The injection valve 20 is mounted on the air pump 10 and includes a positioning seat 21 having a first end provided with an air nozzle 211 inserted into the air outlet 14 of the cylinder 11 and a second end formed with a positioning recess 213, a plurality of flexible locking members 214 each mounted on the positioning seat 21 and each retractably extended into the positioning recess 213 of the positioning seat 21, and a press ring 22 movably mounted on the positioning seat 21 and movable between a first position where the press ring 22 is rested on the locking members 214 to press the locking members 214 into the positioning recess 213 of the positioning seat 21 and a second position where the press ring 22 is detached from the locking members 214 to release the locking members 214 from the positioning recess 213 of the positioning seat 21. The first end of the positioning seat 21 has a peripheral wall provided with an outer thread 212. The press ring 22 is rested on the locking members 214 at a normal state by action of an elastic member 24 biased between the press ring 22 and the positioning seat 21.

The connecting member 30 is mounted between the air outlet 14 of the cylinder 11 of the air pump 10 and the positioning seat 21 of the injection valve 20 to attach the injection valve 20 to the air pump 10. The connecting member 30 has a cylindrical shape and has a first end formed with a first screw bore 31 screwed onto the outer thread 141 of the air outlet 14 of the air pump 10 and a second end formed with a second screw bore 32 screwed onto the outer thread 212 of the positioning seat 21 of the injection valve 20 and having a diameter greater than that of the first screw bore 31. The first screw bore 31 and the second screw bore 32 of the connecting member 30 are separated by a separation wall 33 which has an inside formed with a through hole 34 to allow passage of the air nozzle 211 of the injection valve 20.

The trigger 40 is secured to the press ring 22 of the injection valve 20 to move the press ring 22. The trigger 40 is substantially inverted L-shaped and has a transverse fixing portion 41 secured to a peripheral wall of the press ring 22 and a longitudinal grip portion 42.

The projectile 50 is detachably mounted on the injection valve 20 and includes a mounting seat 52 detachably mounted on the positioning seat 21 of the injection valve 20, and a rocket shaped projectile body 51 mounted on the mounting seat 52. The mounting seat 52 of the projectile 50 is provided with a plug 521 inserted into the positioning recess 213 of the positioning seat 21 and detachably locked by the locking members 214 of the injection valve 20. The plug 521 of the projectile 50 has a peripheral wall formed with a locking groove 522 detachably locked onto the locking members 214 of the injection valve 20. The projectile body 51 of the projectile 50 contains water and gas therein.

Figure 4:
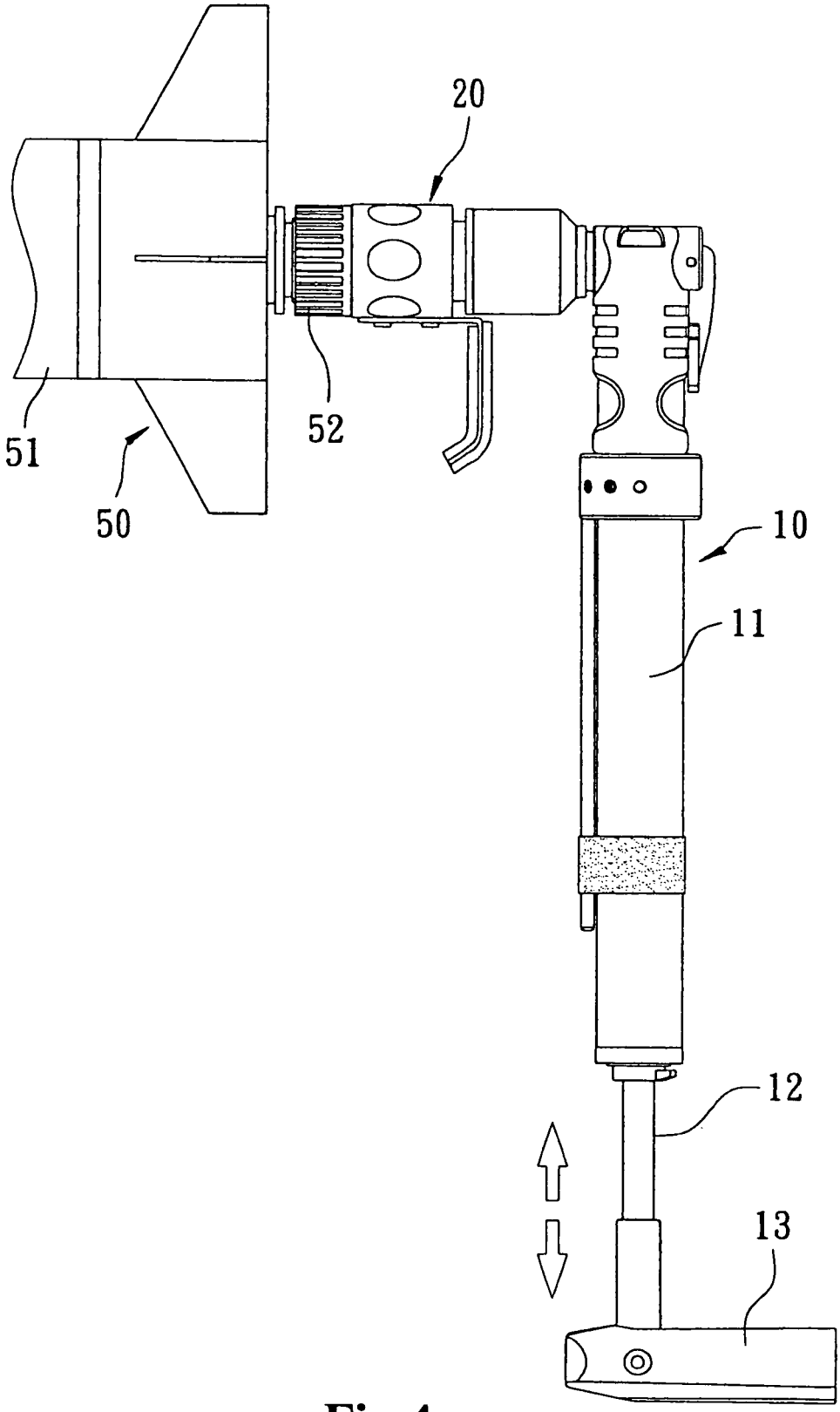
FIG. 4 is a plan cross-sectional operational view of the launch vehicle as shown in FIG. 1.

As shown in FIG. 4, the handle 13 is expanded outwardly to move the piston rod 12 so that the piston rod 12 is movable in the inside of the cylinder 11 successively and reciprocally to fill the ambient air through the air pump 10 and the injection valve 20 into the projectile body 51 of the projectile 50 so as to boost the projectile body 51 of the projectile 50.

Figure 5:
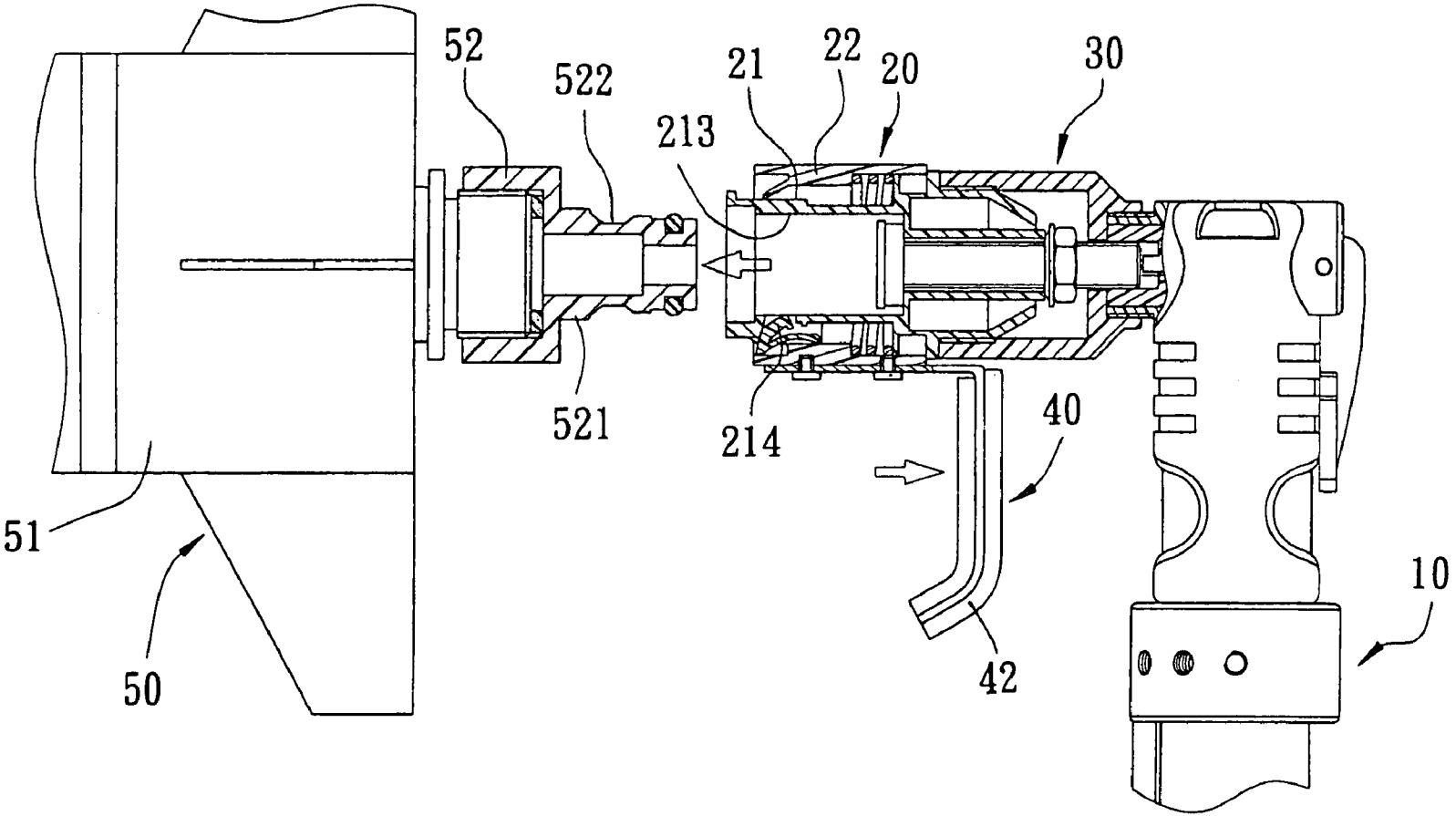
FIG. 5 is a schematic operational view of the launch vehicle as shown in FIG. 3 in use.

As shown in FIG. 5, when the grip portion 42 of the trigger 40 is pressed by the user to move toward the air pump 10, the press ring 22 of the injection valve 20 is pulled by the trigger 40 to move toward the air pump 10, so that the press ring 22 of the injection valve 20 is detached from the locking members 214 to release the locking members 214 from the positioning recess 213 of the positioning seat 21 so as to detach the locking members 214 from the locking groove 522 of the plug 521 of the projectile 50. Thus, the projectile 50 is released from the injection valve 20, so that the projectile 50 is injected outwardly by the pressurized air contained in the projectile body 51 of the projectile 50. In such a manner, the launch vehicle is operated in a hand-held manner.

Figure 6:
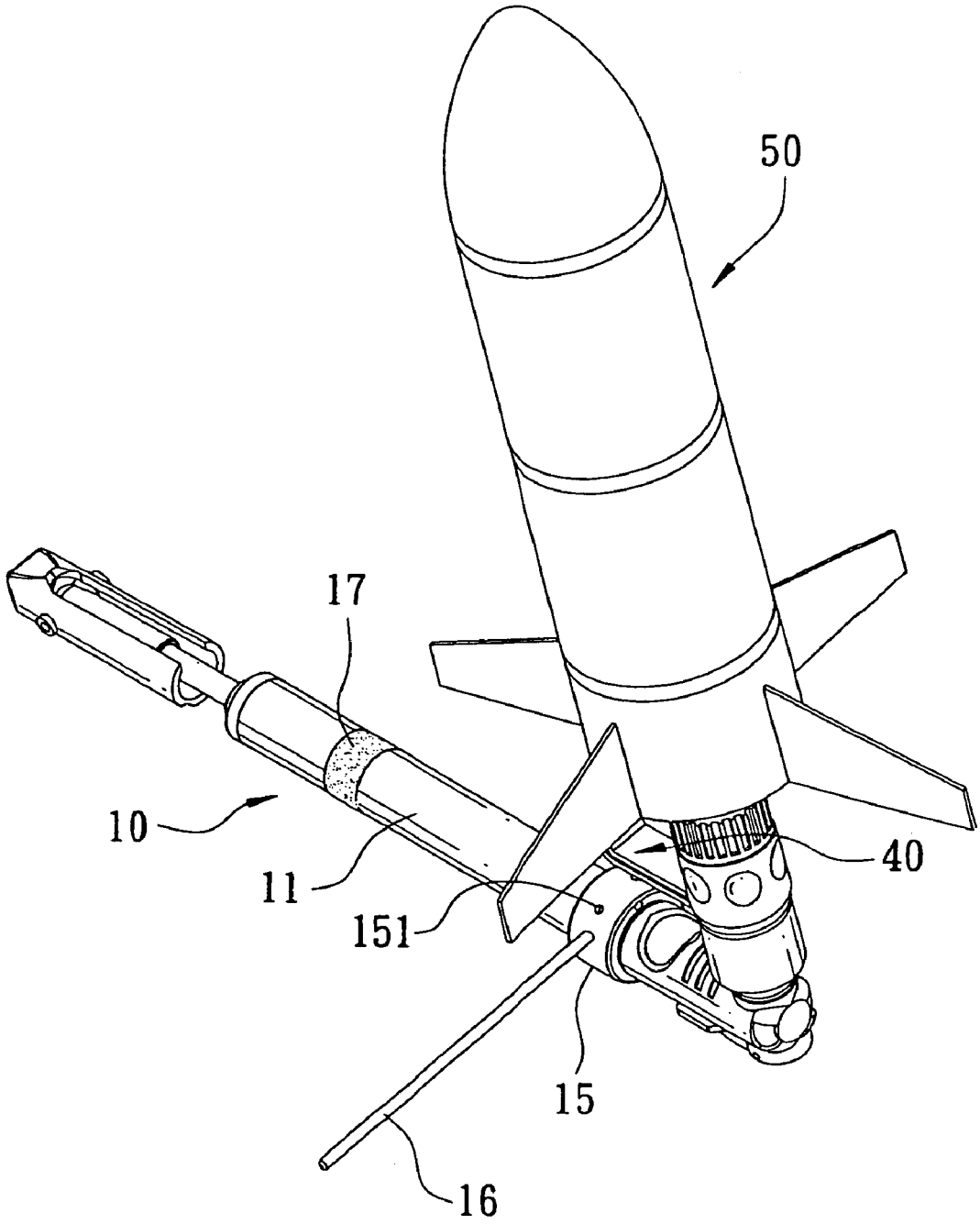
FIG. 6 is a schematic operational view of the launch vehicle as shown in FIG. 1 in use.

As shown in FIG. 6, when the support rod 16 is attached to any one of the positioning holes 151 of the sleeve 15, the support rod 16 and the cylinder 11 of the air pump 10 are perpendicular to each other and are rested on the ground to support the projectile 50 at an upright state, so that the projectile 50 is injected upward. In such a manner, the launch vehicle is operated on the ground. In addition, the support rod 16 is attached to any one of the positioning holes 151 of the sleeve 15 to adjust the inclined angle of the projectile 50.

Figure 7:
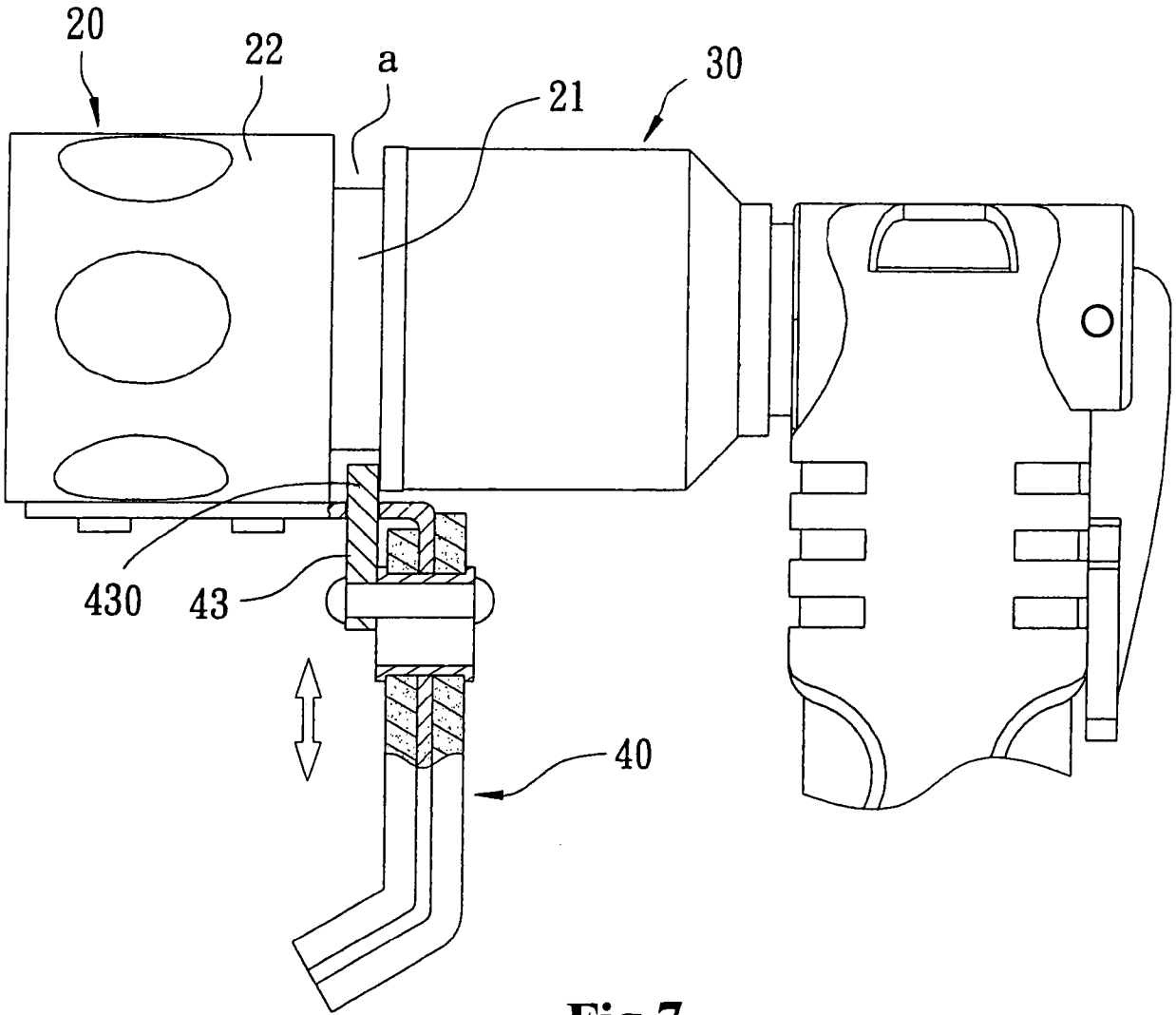
FIG. 7 is a partially plan cross-sectional view of a launch vehicle in accordance with another preferred embodiment of the present invention.

As shown in FIG. 7, the launch vehicle further comprises a safety plate 43 movably mounted on the trigger 40 and having an end 430 detachably inserted into a gap "a" between the press ring 22 of the injection valve 20 and the connecting member 30 to prevent unintentional movement of the press ring 22 of the injection valve 20 toward the air pump 10.

Figure 8:
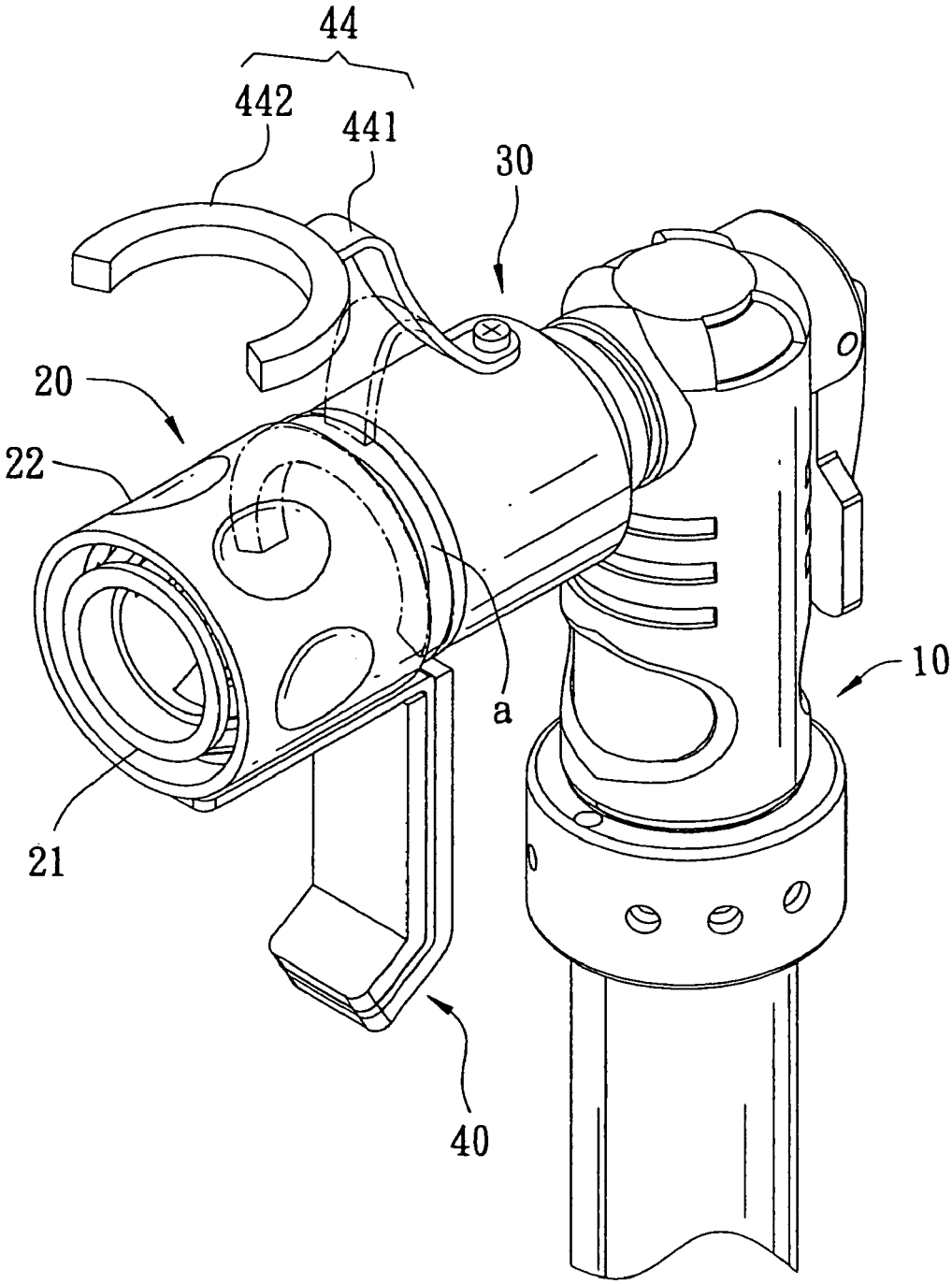
FIG. 8 is a partially perspective operational view of a launch vehicle in accordance with another preferred embodiment of the present invention.

As shown in FIG. 8, the launch vehicle further comprises a safety module 44 including a flexible member 441 having a first end mounted on the connecting member 30, and a substantially C-shaped clip 442 mounted on a second end of the flexible member 441 and detachably inserted into the gap "a" between the press ring 22 of the injection valve 20 and the connecting member 30 to prevent unintentional movement of the press ring 22 of the injection valve 20 toward the air pump 10.

Accordingly, the launch vehicle is operated on the ground and is also operated in a hand-held manner, thereby enhancing the amusement effect of the launch vehicle. In addition, the user only needs to hold the air pump 10 and the trigger 40 so as to launch the projectile 50 easily and conveniently in an energy-saving manner, thereby facilitating the user operating the launch vehicle. Further, the launch vehicle has a simplified construction to perform the hand-held launching function, thereby decreasing the costs of fabrication. Further, the launch vehicle has a smaller volume and is carried easily and conveniently, thereby facilitating the user carrying and storing the launch vehicle. Further, the launch vehicle is further provided with a safety device to prevent the trigger 40 from being triggered unintentionally so as to protect the user's safety.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A launch vehicle, comprising:

an air pump including a cylinder having an upper end formed with an air outlet connected to an inside of the cylinder and a lower end provided with a piston rod movable in the inside of the cylinder;

an injection valve mounted on the air pump and including a positioning seat having a first end provided with an air nozzle inserted into the air outlet of the cylinder and a second end formed with a positioning recess, a plurality of flexible locking members each mounted on the positioning seat and each retractably extended into the positioning recess of the positioning seat, and a press ring movably mounted on the positioning seat and movable between a first position where the press ring is rested on the locking members to press the locking members into the positioning recess of the positioning seat and a second position where the press ring is detached from the locking members to release the locking members from the positioning recess of the positioning seat;

a connecting member mounted between the air outlet of the cylinder of the air pump and the positioning seat of the injection valve to attach the injection valve to the air pump;

a trigger secured to the press ring of the injection valve to move the press ring;

a projectile detachably mounted on the injection valve and including a mounting seat detachably mounted on the positioning seat of the injection valve, and a projectile body mounted on the mounting seat, wherein the mounting seat of the projectile is provided with a plug inserted into the positioning recess of the positioning seat and detachably locked by the locking members of the injection valve.

2. The launch vehicle in accordance with claim 1, wherein the plug of the projectile has a peripheral wall formed with a locking groove detachably locked onto the locking members of the injection valve.

3. The launch vehicle in accordance with claim 1, wherein the piston rod has a lower end provided with a foldable handle.

4. The launch vehicle in accordance with claim 1, wherein the connecting member has a cylindrical shape.

5. The launch vehicle in accordance with claim 1, wherein air outlet of the cylinder has a peripheral wall provided with an outer thread, the first end of the positioning seat has a peripheral wall provided with an outer thread, and the connecting member has a first end formed with a first screw bore screwed onto the outer thread of the air outlet of the air pump and a second end formed with a second screw bore screwed onto the outer thread of the positioning seat of the injection valve.

6. The launch vehicle in accordance with claim 5, wherein the second screw bore of the connecting member has a diameter greater than that of the first screw bore.

7. The launch vehicle in accordance with claim 5, wherein the first screw bore and the second screw bore of the connecting member are separated by a separation wall.

8. The launch vehicle in accordance with claim 7, wherein the separation wall has an inside formed with a through hole to allow passage of the air nozzle of the injection valve.

9. The launch vehicle in accordance with claim 1, wherein the trigger is substantially inverted L-shaped.

10. The launch vehicle in accordance with claim 1, wherein the trigger has a transverse fixing portion secured to a peripheral wall of the press ring and a longitudinal grip portion.

11. The launch vehicle in accordance with claim 1, wherein the press ring is rested on the locking members at a normal state by action of an elastic member biased between the press ring and the positioning seat.

12. The launch vehicle in accordance with claim 1, wherein the air pump further includes a sleeve mounted on an outer wall of the cylinder, and a support rod mounted on the cylinder and having a first end detachably secured to the sleeve.

13. The launch vehicle in accordance with claim 12, wherein the air pump further includes an elastic clamping ring mounted on the cylinder and rested on a second end of the support rod.

14. The launch vehicle in accordance with claim 12, wherein the sleeve has a plurality of radially extending threaded positioning holes arranged in an annular manner and an axially extending threaded fixing hole perpendicular to each of the positioning holes.

15. The launch vehicle in accordance with claim 14, wherein the first end of the support rod has a threaded portion selectively screwed into the fixing hole of the sleeve or any one of the positioning holes of the sleeve.

16. The launch vehicle in accordance with claim 14, wherein when the support rod is attached to any one of the positioning holes of the sleeve, the support rod and the cylinder of the air pump are perpendicular to each other to support the projectile at an upright state.

17. The launch vehicle in accordance with claim 14, wherein the support rod is attached to any one of the positioning holes of the sleeve to adjust an inclined angle of the projectile.

18. The launch vehicle in accordance with claim 2, wherein when the trigger is pressed toward the air pump, the press ring of the injection valve is pulled by the trigger to move toward the air pump, so that the press ring of the injection valve is detached from the locking members to release the locking members from the positioning recess of the positioning seat so as to detach the locking members from the locking groove of the plug of the projectile.

19. The launch vehicle in accordance with claim 1, further comprising a safety plate movably mounted on the trigger and having an end detachably inserted into a gap between the press ring of the injection valve and the connecting member to prevent movement of the press ring of the injection valve toward the air pump.

20. The launch vehicle in accordance with claim 1, further comprising a safety module including a flexible member having a first end mounted on the connecting member, and a substantially C-shaped clip mounted on a second end of the flexible member and detachably inserted into a gap between the press ring of the injection valve and the connecting member to prevent movement of the press ring of the injection valve toward the air pump.

* * * * *